US010603537B2

(12) United States Patent
Collier

(10) Patent No.: US 10,603,537 B2
(45) Date of Patent: Mar. 31, 2020

(54) KETTLE BELL

(71) Applicant: Daniel Collier, Ennis, MT (US)

(72) Inventor: Daniel Collier, Ennis, MT (US)

( * ) Notice: Subject to any disclaimer, the term of this patent is extended or adjusted under 35 U.S.C. 154(b) by 17 days.

(21) Appl. No.: 15/582,982

(22) Filed: May 1, 2017

(65) Prior Publication Data

US 2018/0311525 A1 Nov. 1, 2018

(51) Int. Cl.

| | |
|---|---|
| ***A63B 21/072*** | (2006.01) |
| ***A63B 21/00*** | (2006.01) |
| ***A63B 23/035*** | (2006.01) |
| ***A63B 21/075*** | (2006.01) |
| ***A63B 21/04*** | (2006.01) |

(52) U.S. Cl.

CPC ..... *A63B 21/072* (2013.01); *A63B 21/075* (2013.01); *A63B 21/4017* (2015.10); *A63B 23/03508* (2013.01); *A63B 21/04* (2013.01); *A63B 21/4043* (2015.10)

(58) Field of Classification Search

CPC ..... A63B 21/0004; A63B 21/00058; A63B 21/00061; A63B 21/00065; A63B 21/00069; A63B 21/00072; A63B 21/00076; A63B 21/062; A63B 21/0622; A63B 21/0624; A63B 21/0628; A63B 21/063; A63B 21/0632; A63B 21/072; A63B 21/0722; A63B 21/0724; A63B 21/0726; A63B 21/0728; A63B 21/075; A63B 21/08; A63B 21/15; A63B 21/159; A63B 21/4017; A63B 21/4019; A63B 21/4023; A63B 21/4027; A63B 21/4033; A63B 21/0435; A63B 21/4039; A63B 21/4041; A63B 21/4043; A63B 23/035; A63B 23/03508; A63B 23/03516; A63B 23/03525; A63B 71/0036; A63B 2210/00; A63B 2210/50; A63B 2225/09; A63B 2225/093; A63B 2244/09

See application file for complete search history.

(56) References Cited

U.S. PATENT DOCUMENTS

| | | | | | |
|---|---|---|---|---|---|
| 1,316,683 | A * | 9/1919 | Calvert | A63B 21/072 | 473/125 |
| 4,345,756 | A * | 8/1982 | Hoagland | A63B 21/075 | 482/109 |
| 4,537,394 | A * | 8/1985 | Golinsky, Jr. | A63B 21/072 | 482/109 |
| 4,641,836 | A * | 2/1987 | Clifton | A63B 23/1263 | 482/109 |
| 4,717,147 | A * | 1/1988 | Rochelle | A63B 21/0724 | 294/15 |
| 5,496,240 | A * | 3/1996 | Damm | A63B 21/072 | 482/93 |
| 5,540,640 | A * | 7/1996 | Povilaitis | A63B 21/072 | 482/106 |

(Continued)

*Primary Examiner* — Gary D Urbiel Goldner
(74) *Attorney, Agent, or Firm* — Merchant & Gould P.C.

(57) ABSTRACT

Kettlebell embodiments with improved ergonomics. In some embodiments, the weight of the kettlebell is also adjustable. The kettlebell has handle portions that are angled relative to each other that extend in a generally horizontal plane. In use, these handle configurations result in improved ergonomics. The kettlebell handles enable the users to grab the kettlebell with two hands with improved balance and range of motion.

13 Claims, 14 Drawing Sheets

(56) References Cited

U.S. PATENT DOCUMENTS 5,827,157 A * 10/1998 Lee ..... A63B 21/06 482/93
5,967,948 A * 10/1999 Carr ..... A63B 21/072 482/106
6,196,951 B1 * 3/2001 Shepherd ..... A63B 21/072 482/106
6,689,022 B1 * 2/2004 Emick ..... A63B 21/06 482/93
7,137,930 B1 * 11/2006 Carr ..... A63B 21/072 482/98
7,476,183 B1 * 1/2009 Chrest ..... A63B 21/072 482/908
7,563,208 B1 * 7/2009 Chen ..... A63B 21/0728 482/108
7,731,640 B1 * 6/2010 Chen ..... A63B 21/075 482/108
7,883,452 B1 * 2/2011 Chen ..... A63B 21/072 482/108
D653,715 S * 2/2012 Tumminia ..... A63B 21/072 D21/679
8,267,841 B1 * 9/2012 Allison ..... A63B 21/06 482/106
8,684,889 B1 * 4/2014 Berrisford ..... A63B 21/4035 482/107
9,498,676 B1 * 11/2016 Emick ..... A63B 23/04
9,925,443 B2 * 3/2018 Roberson ..... A63B 65/04
10,188,899 B1 * 1/2019 Acuna, Jr. ..... A63B 21/4035
2007/0135274 A1 * 6/2007 Blateri ..... A63B 21/075 482/109
2008/0081744 A1 * 4/2008 Gormley ..... A63B 21/072 482/93
2010/0190619 A1 * 7/2010 Chen ..... A63B 21/072 482/108
2011/0111929 A1 * 5/2011 Allison ..... A63B 21/072 482/108
2011/0275494 A1 * 11/2011 Radi ..... A63B 21/0602 482/93
2012/0252641 A1 * 10/2012 Odneal ..... A63B 21/072 482/108
2014/0024506 A1 * 1/2014 Vixathep ..... A63B 21/0726 482/108
2014/0057764 A1 * 2/2014 Klukas ..... A63B 15/00 482/109
2014/0287891 A1 * 9/2014 Marich ..... A63B 21/072 482/108
2015/0105224 A1 * 4/2015 Odneal ..... A63B 21/0726 482/107
2015/0174445 A1 * 6/2015 Robertson, Jr. .... A63B 23/0405 482/93
2015/0335935 A1 * 11/2015 Peralo ..... A63B 21/4035 482/93
2016/0144219 A1 * 5/2016 Koenig ..... A63B 21/075 482/93
2017/0225025 A1 * 8/2017 Towley ..... A63B 21/075
2017/0246495 A1 * 8/2017 Wyncott ..... A63B 21/075
2017/0368404 A1 * 12/2017 Scoffin ..... A63B 71/06

* cited by examiner

KETTLE BELL

Kettlebells are typically cast-iron ball shaped weights with a flat bottom with a thick handle on top. They are commonly used to perform exercises that combine cardiovascular, strength and flexibility training. To facilitate the performance of existing exercises and new exercises there is a need for kettlebells with improved ergonomics and improved adjustability.

SUMMARY

The present disclosure provides kettlebell embodiments with improved ergonomics. In some embodiments, the weight of the kettlebell is also adjustable.

DETAILED DESCRIPTION

Figure 1:
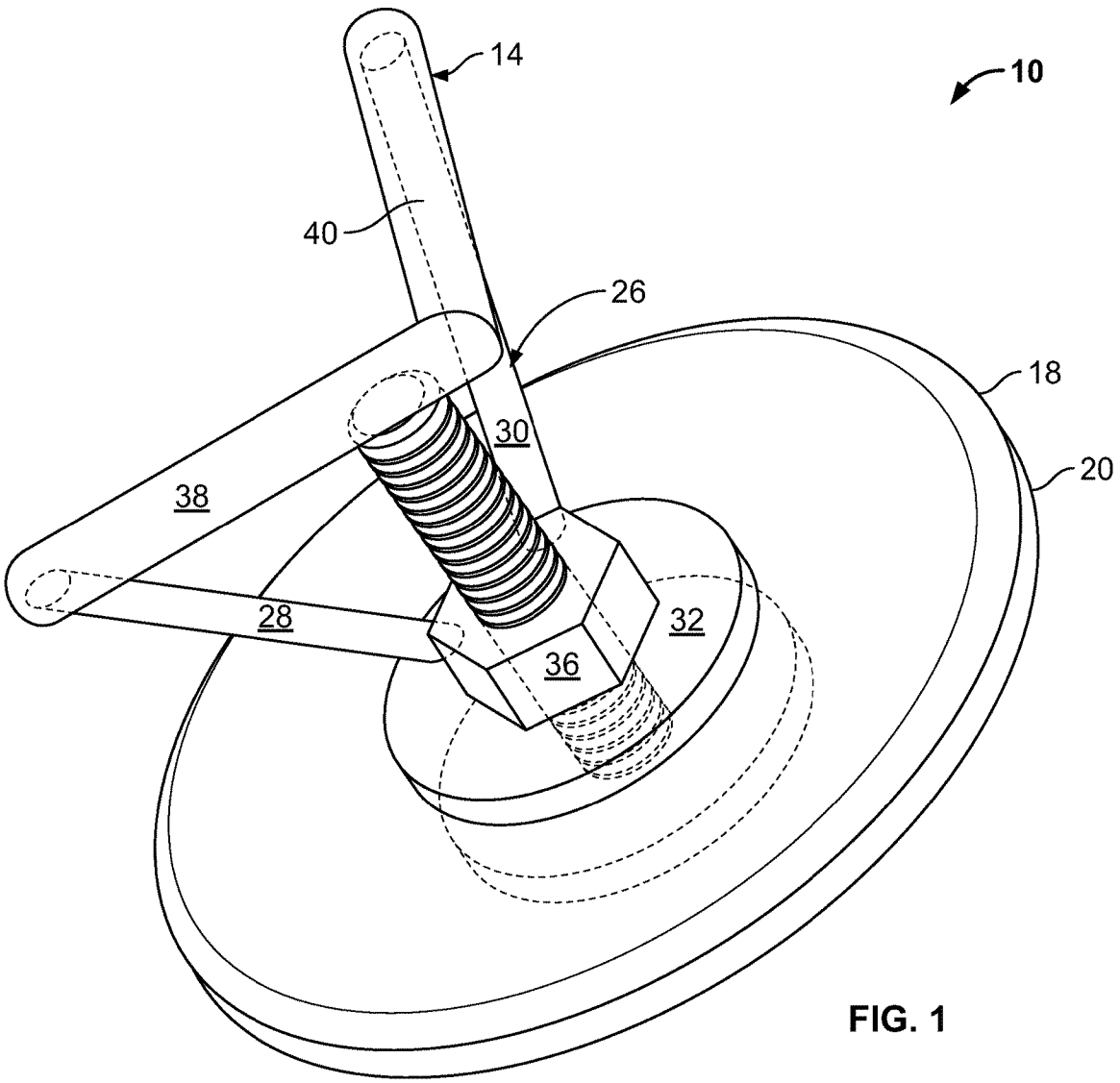
FIG. 1 is an isometric view of an embodiment of the kettlebell according to the principles of the present disclosure wherein the weight of the kettlebell is adjustable.
Figure 2:
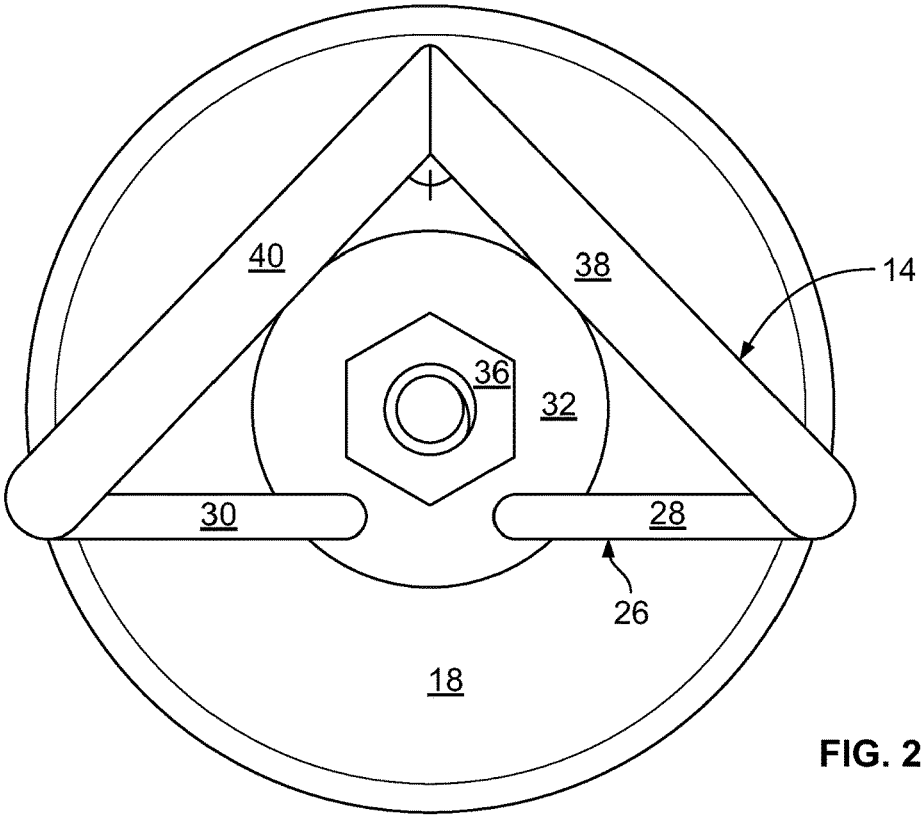
FIG. 2 is a top view of the kettlebell of FIG. 1.
Figure 3:
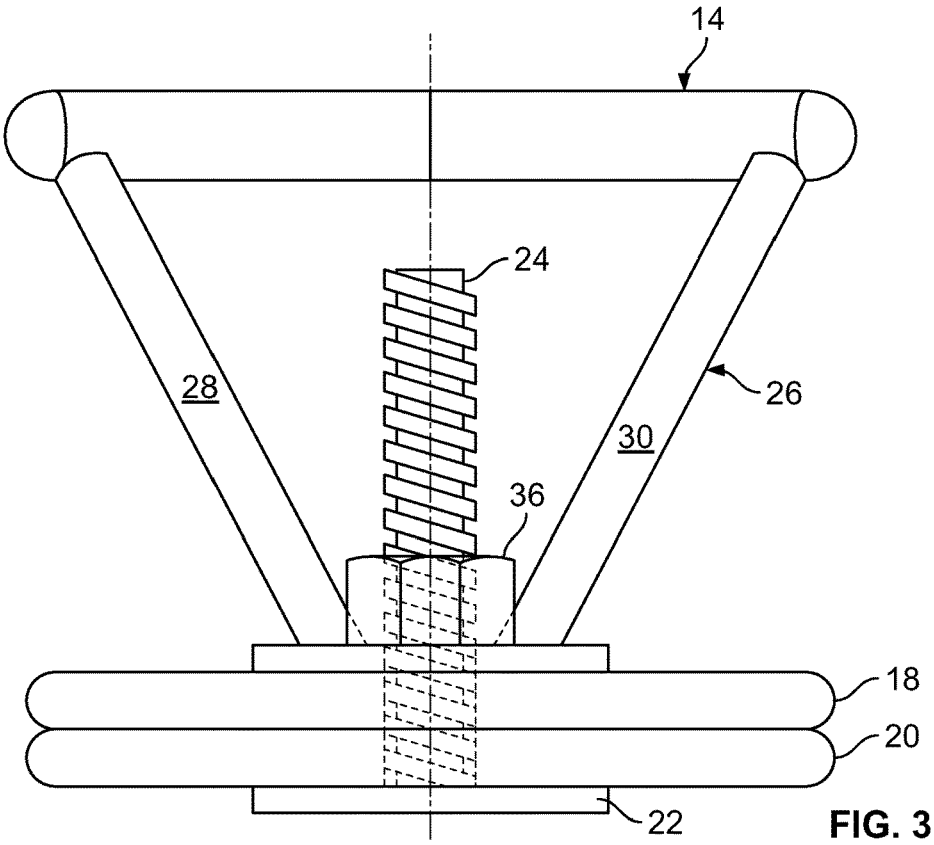
FIG. 3 is a side view of the kettlebell of FIG. 1.
Figure 4:
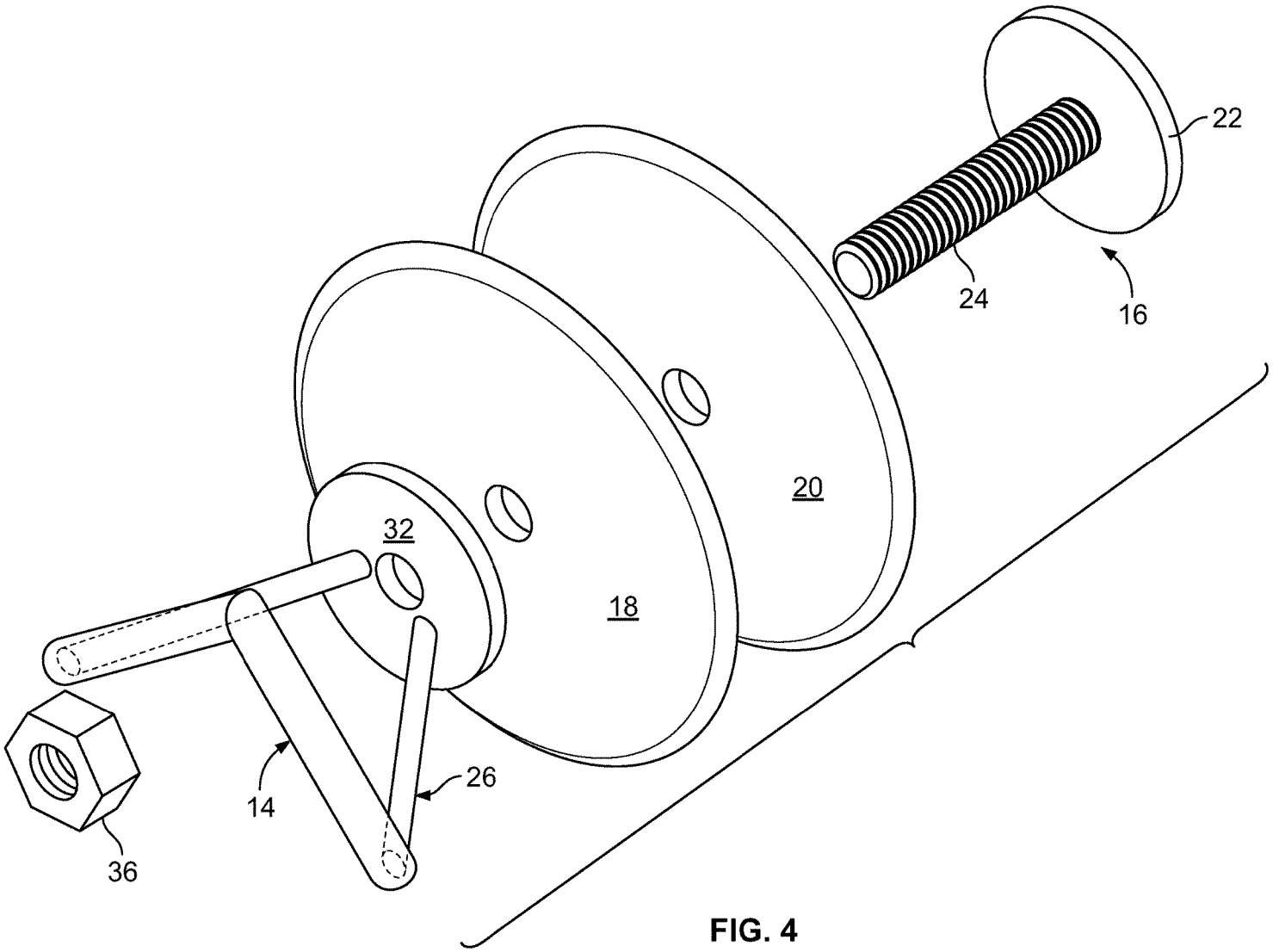
FIG. 4 is an assembly view of the kettlebell of FIG. 1.

Referring generally to FIGS. 1-4, a first embodiment of the kettlebell is described in further detail. In the depicted embodiment, the kettlebell 10 has a non-traditional configuration. Generically the kettlebell of the present disclosure is a weighted exercise device with a body and a handle 14 connected to the body. In the depicted embodiment the handle is spaced away from the body and connected to the body via a riser configuration. In some embodiment the riser is part of the overall handle structure that functions to connect the handle to the body and provide space between the body and the handle. It should be appreciated that the risers can be integrally formed with the body or alternatively it can be a separate component from the body or handle.

In the depicted embodiment, the body includes a base assembly 16 that is configured to secure a plurality of plate weights 18, 20. In the depicted embodiment, the base assembly 16 includes a plate base 22 from which a post 24 extends. The post 24 is configured to extend though a center aperture in the plate weights 18, 20. In the depicted embodiment, the post 24 is threaded. It should be appreciated that many alternative configurations are possible.

In the depicted embodiment, the handle 14 is connected to the body via a riser 26. The riser 26 includes legs 28, 30 that extend downwardly to top plate 32 (part of the body). The top plate 32 includes an aperture 34 that is configured to receive the post 24 (also referred to therein as a boss). In the depicted embodiment, a nut 36 is secure to the post 24 upper side of the top plate 32 to secure the riser 26 to the base assembly 16 thereby sandwiching the plate weights 18, 20 therebetween. In an alternative embodiment the nut can be welded to the top plate or the top plate itself can be threaded such that spinning the riser about the post sandwiches the plate weight 18, 20 between the riser 26 and the base assembly 16. Many other alternative configurations are also possible.

In the depicted embodiment, the legs 28, 30 are arranged and configured such that when the handles are lifted vertically the mass of the body does not apply a substantial torque to the user's hands. The risers are configured to positon the user's hands when gripped on the handle 14 balanced about the center of mass of the body 12. It should be appreciated that a number of alternative riser configurations are possible some of which are show in the figures and described herein in further detail below.

In the depicted embodiment, the handle 14 includes a first portion 38 and a second portion 40 that define an angle relative to each other. In the depicted embodiment, the angle is between 30 and 60 degrees (for example, 40 degrees, 45 degrees, or 50 degrees) relative to a center line that bisects the handle portions. Accordingly, in the depicted embodiment, the angle between the first portion 38 and the second portion 40 relative to each other is between 60 and 120 degrees as is illustrated in the figures (e.g., FIGS. 2, 8, 12, 15, and 21). In some embodiments, the angle between the first and second portions 38, 40 is between 60 and 110 degrees. In the depicted embodiment, the first and second portions 38, 40 are generally in the same horizontal plane. It should be appreciated that other nonstandard non-straight handle configurations are possible including handles that are curved, horse shoe shaped, triangular shaped, diamond shaped, generally circular with straight portions, etc. Some of these example configurations are depicted in the figures.

In the depicted embodiment the handle is bar shaped. It should be appreciated that the handle can have a number of different alternative configurations. For example, they could be rubber grips that slide over the bar, they could be knurled metal, and they could be bulges or otherwise specifically contoured to fit the user's hand. Many other handle configurations are possible.

Figure 5:
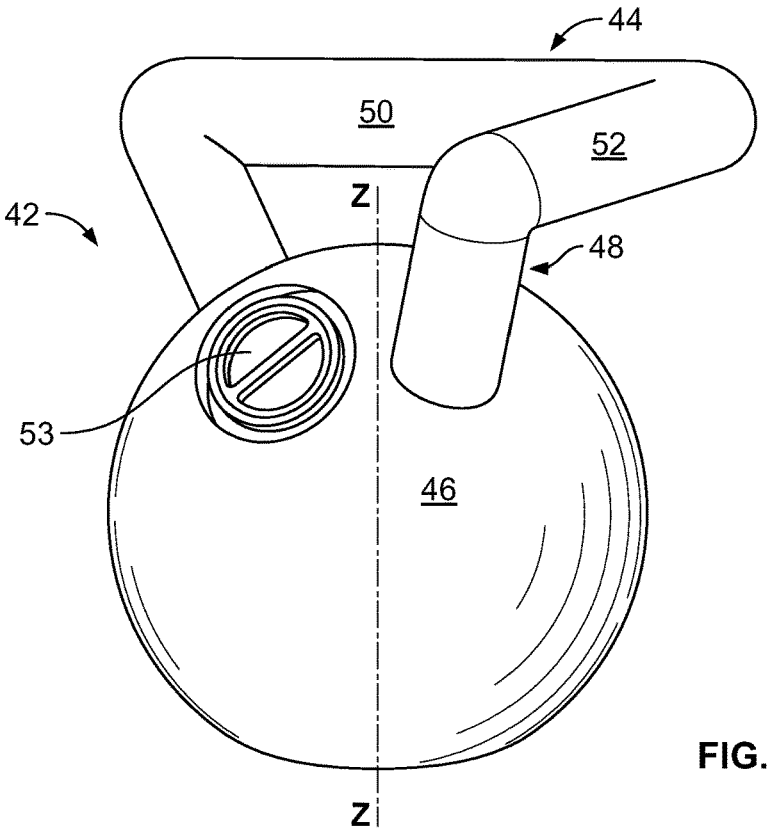
FIG. 5 is an isometric view of an alternative embodiment of the kettlebell of FIG. 1 that includes a fillable void therein.
Figure 6:
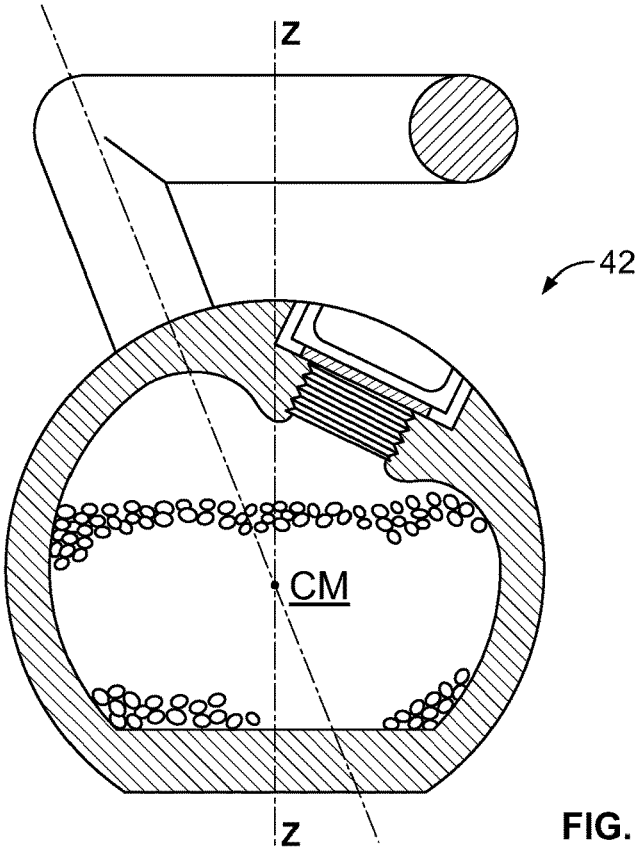
FIG. 6 is a cross sectional view of the kettlebell of FIG. 5 along line 6-6.
Figure 7:
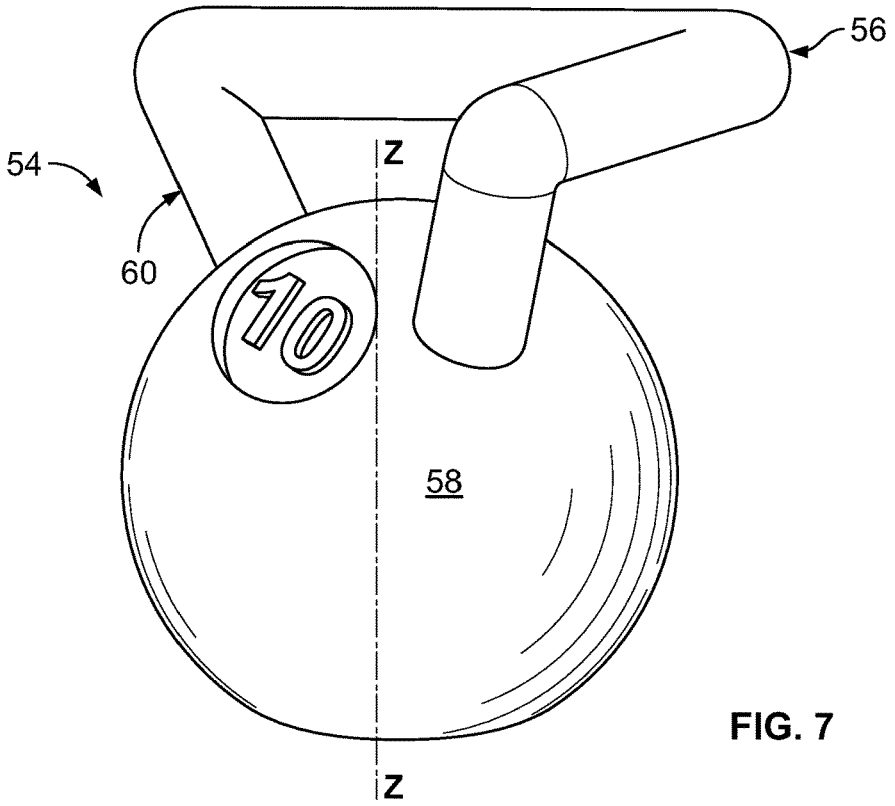
FIG. 7 is an isometric view of an alternative embodiment of the kettlebell of FIG. 1 that includes a handle having two legs.
Figure 8:
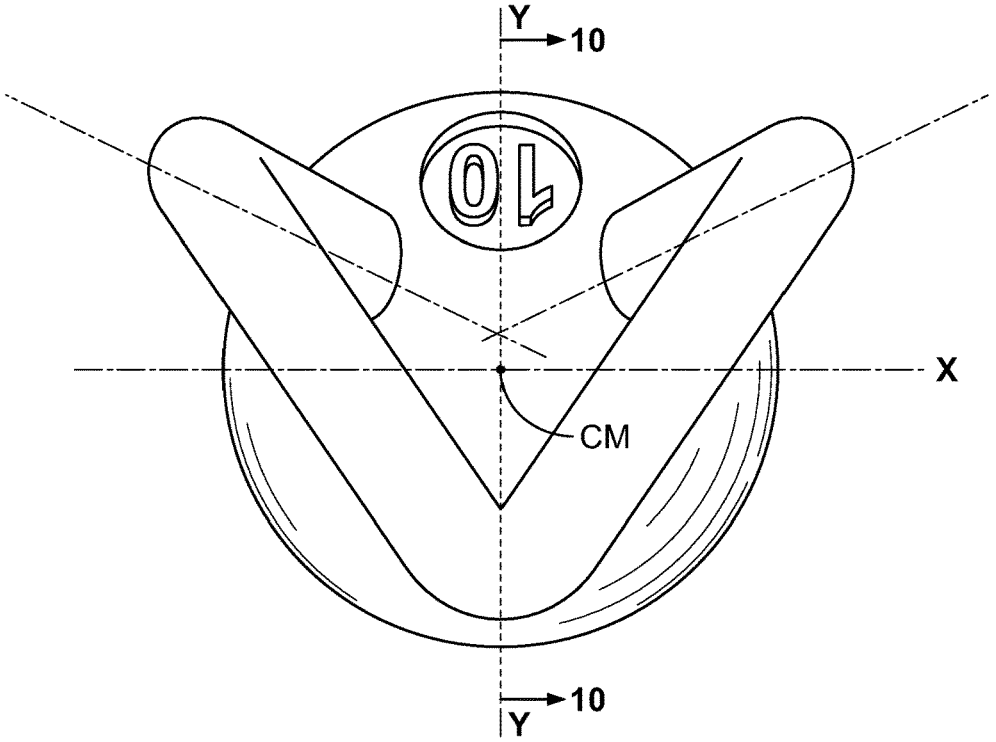
FIG. 8 is a top view of the kettlebell of FIG. 7.
Figure 9:
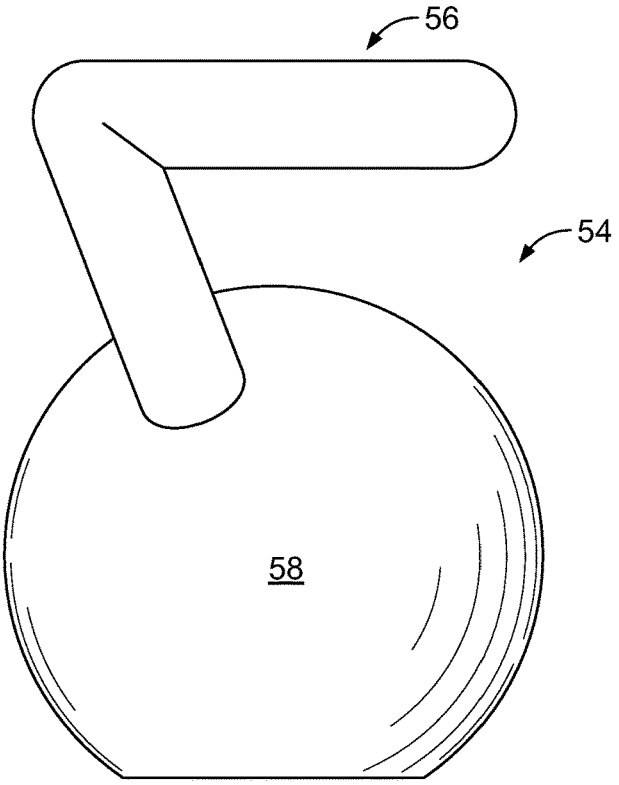
FIG. 9 is a side view of the kettlebell of FIG. 7.
Figure 10:
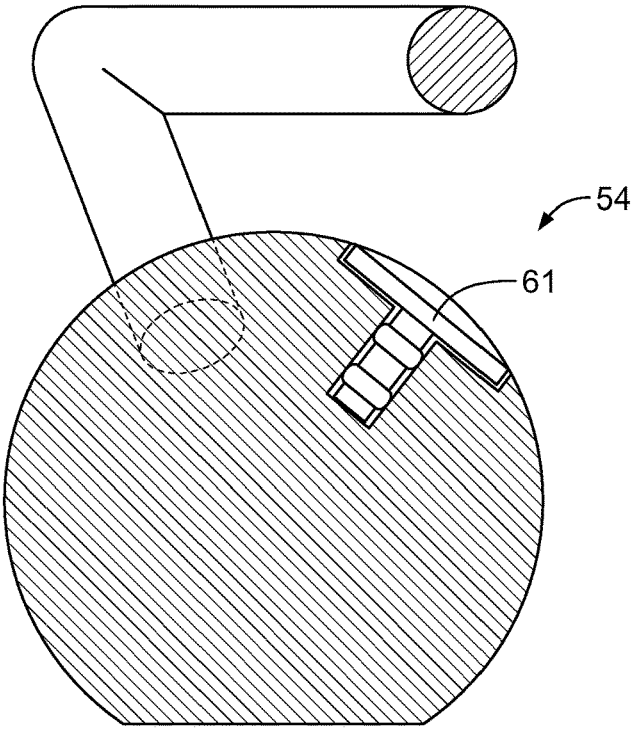
FIG. 10 is a cross sectional view of the kettlebell of FIG. 7 along line 10-10.

Referring generally to FIGS. 5-6, an alternative embodiment of the weighted exercise device is shown. In the depicted embodiment, the weighted exercise device 42 includes a handle 44, a body 46, and a riser 48. The handle includes a first portion 50 and a second portion 52 that are at an angle relative to each other. In the depicted embodiment, the first and second portions 50, 52 are in the same horizontal plane, when the body 46 is resting on its base on a horizontal surface. In the depicted embodiment, the center of mass CM of the body is located between the first and second portions 50, 52 of the handle. In the depicted embodiment, the center handle is centered about the center of mass CM such that the first portion 50 is equal distance from the center of mass CM as the second portion 52. Each of the first and second portions 50, 52 include portions forward and rearward of the center of mass CM.

In the depicted embodiment, the body 46 defines an enclosed cavity that can be filled (partially or completely) to add weight to the body. The fill could be for example, water, sand, lead, or steel shot. In the depicted embodiment, the body includes a fill plug 53 that can seal the cavity. The plug can be configured to be removable or permanently seal once filled. In the depicted embodiment, the body is form of a plastic material (e.g., nylon). In the depicted embodiment, the body, riser, and handle are all formed as an integral molded part. It should be appreciated that many other configurations and methods of manufacture are also possible.

Referring generally to FIGS. 7-10, an alternative embodiment of the weighted exercise device is shown. In the depicted embodiment, the weighted exercise device 54 includes a handle 56, a body 58, and a riser 60. This embodiment is similar to the other previously described embodiments. However, in this embodiment the body is a solid mass (e.g., steel or cast iron). The size of the body is proportional to the weight of the body, which may or may not be the case with respect to the embodiment with hollow body cavities. In the depicted embodiment, a press fit plug 61 is press into the body that includes an identifier. The identifier indicates the weight of the particular weighted exercise device.

Figure 11:
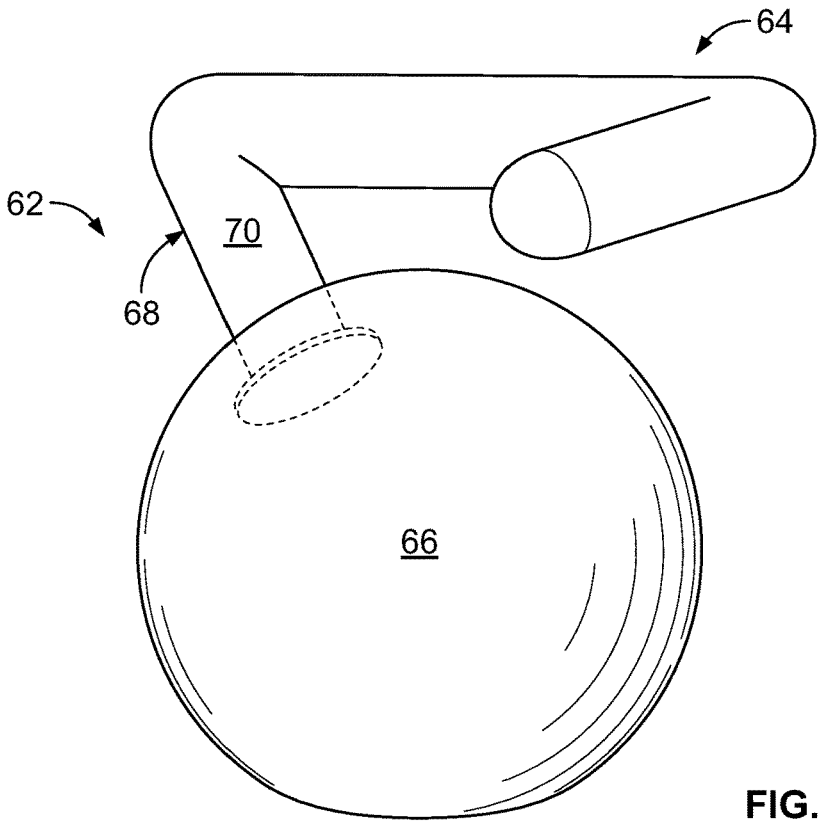
FIG. 11 is an isometric view of an alternative embodiment of the kettlebell of FIG. 1 that includes a handle having a single offset leg.
Figure 12:
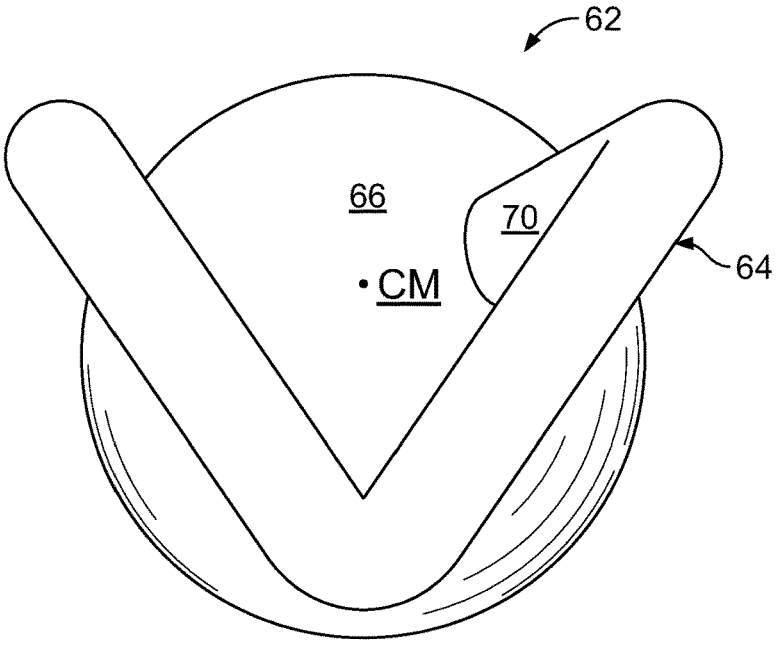
FIG. 12 is a top view of the kettlebell of FIG. 11.
Figure 13:
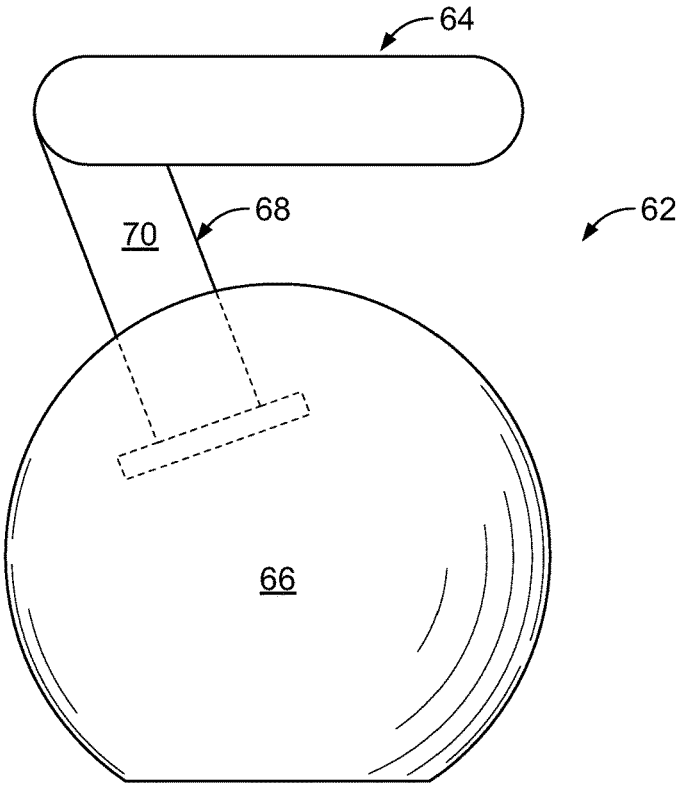
FIG. 13 is a side view of the kettlebell of FIG. 11.

Referring generally to FIGS. 11-13, an alternative embodiment of the weighted exercise device is shown. In the depicted embodiment, the weighted exercise device 62 includes a handle 64, a body 66, and a riser 68. This embodiment is similar to the other previously described embodiments. However, in this embodiment the riser includes only one leg 70. The leg 70 is welded, bolted, or pressed into the body at an orientation and positon such that the handle is balance over the center of mass CM. In the depicted embodiment, the leg 70 extens from one end of the handle and is at an angle from the vertical direction when the body is resting on a horizontal surface. In the depicted embodiment, the handle is cantilever in both a front to back direction as well as a side to side direction.

Figure 14:
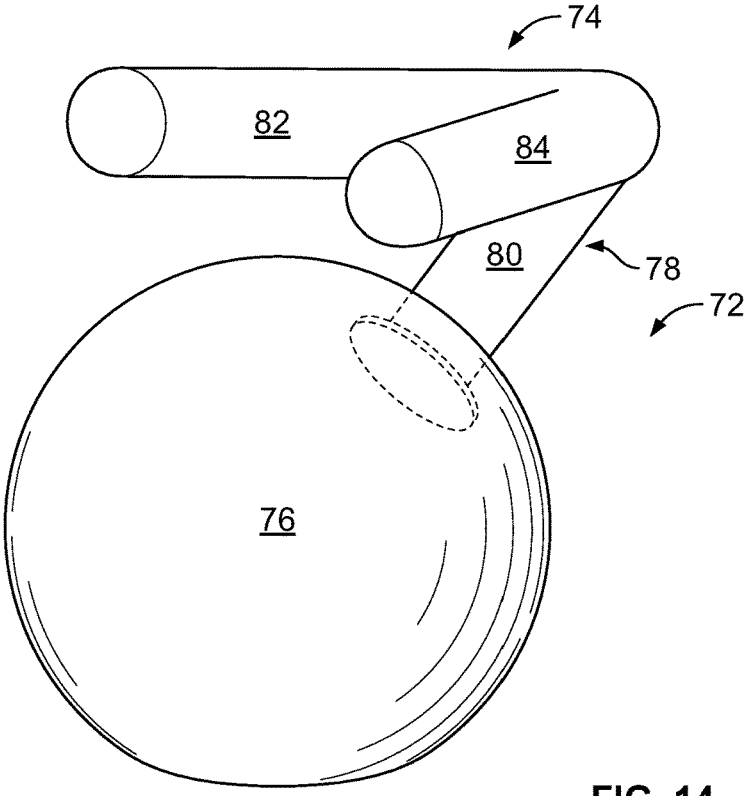
FIG. 14 is an isometric view of an alternative embodiment of the kettlebell of FIG. 1 that includes a handle having a single center leg.
Figure 15:
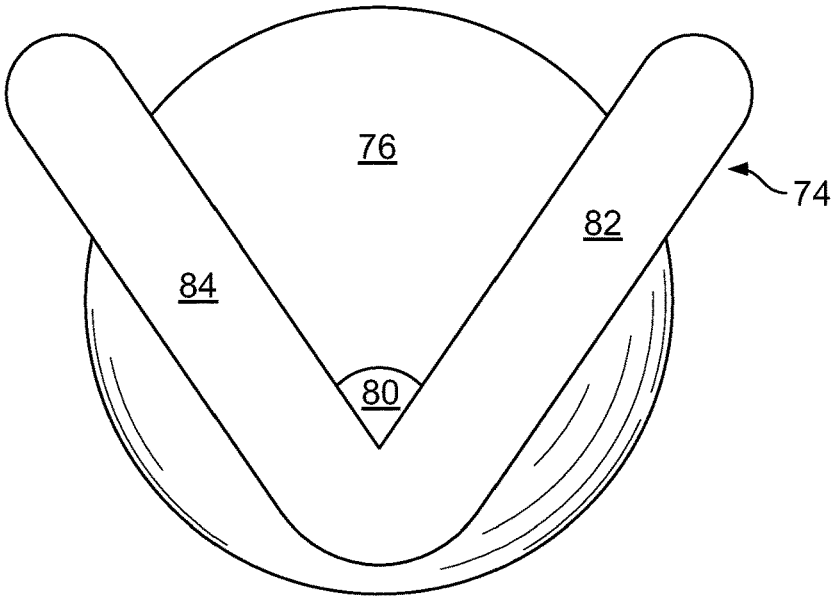
FIG. 15 is a top view of the kettlebell of FIG. 14.
Figure 16:
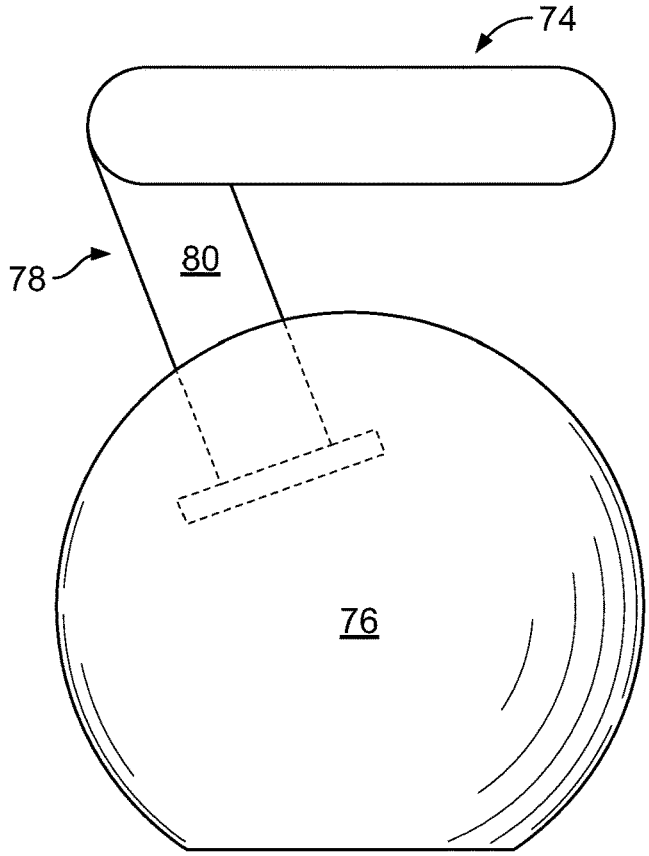
FIG. 16 is a side view of the kettlebell of FIG. 14.

Referring generally to FIGS. 14-16, an alternative embodiment of the weighted exercise device is shown. In the depicted embodiment, the weighted exercise device 72 includes a handle 74, a body 76, and a riser 78. This embodiment is similar to the other previously described embodiments. In this embodiment, the riser includes only one leg 80. The leg 80 connected to the body at an orientation and positon such that the handle is balance over the center of mass CM. In the depicted embodiment, the leg 80 extends from a center portion of the handle between a first portion 82 and a second portion 84. The leg 84 is at an angle from the vertical when the body is resting on a horizontal surface. In the depicted embodiment, the handle is cantilever in both a front to back direction as well as a side to side direction.

Figure 17:
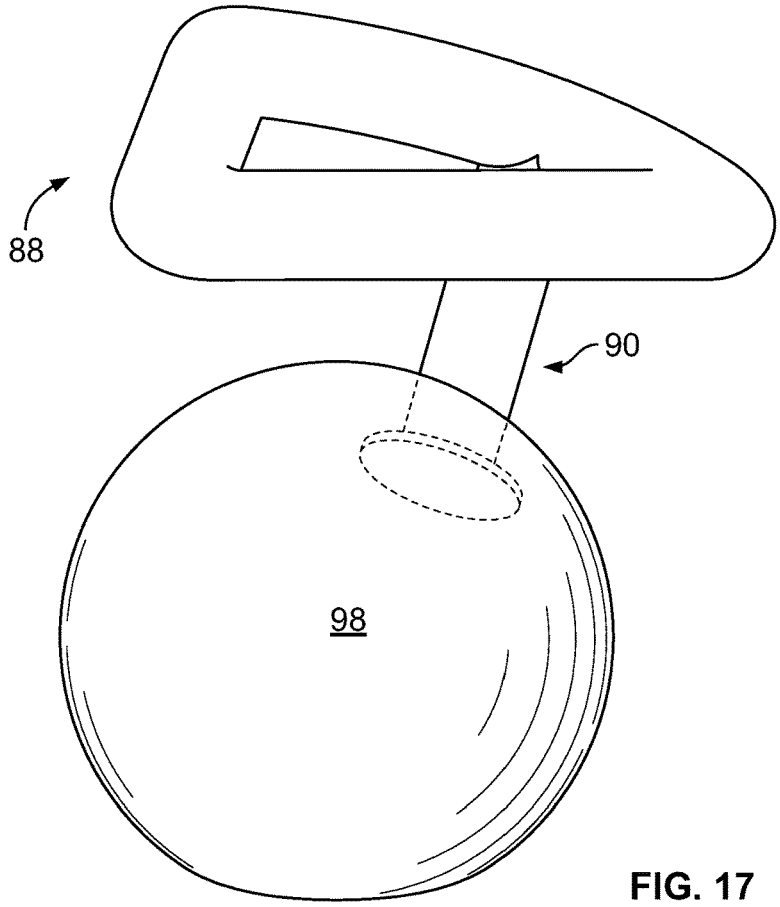
FIG. 17 is an isometric view of an alternative embodiment of the kettlebell of FIG. 1 that includes a handle having a single leg and three arm members.
Figure 18:
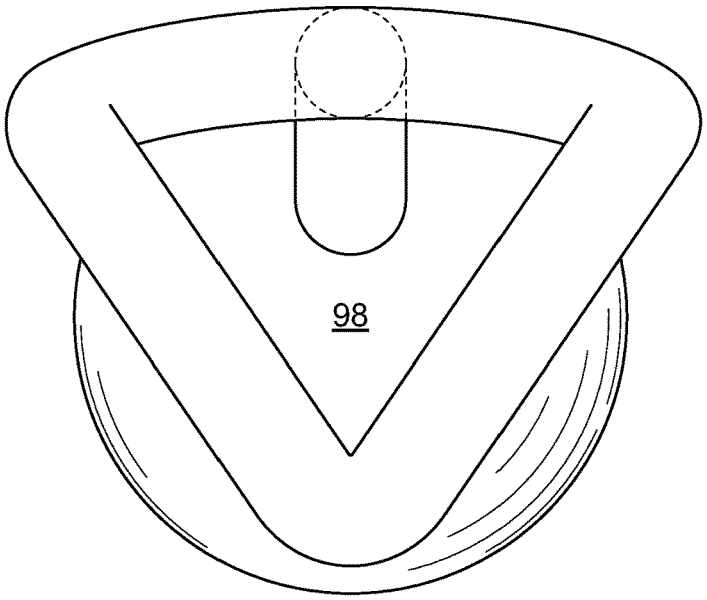
FIG. 18 is a top view of the kettlebell of FIG. 17.
Figure 19:
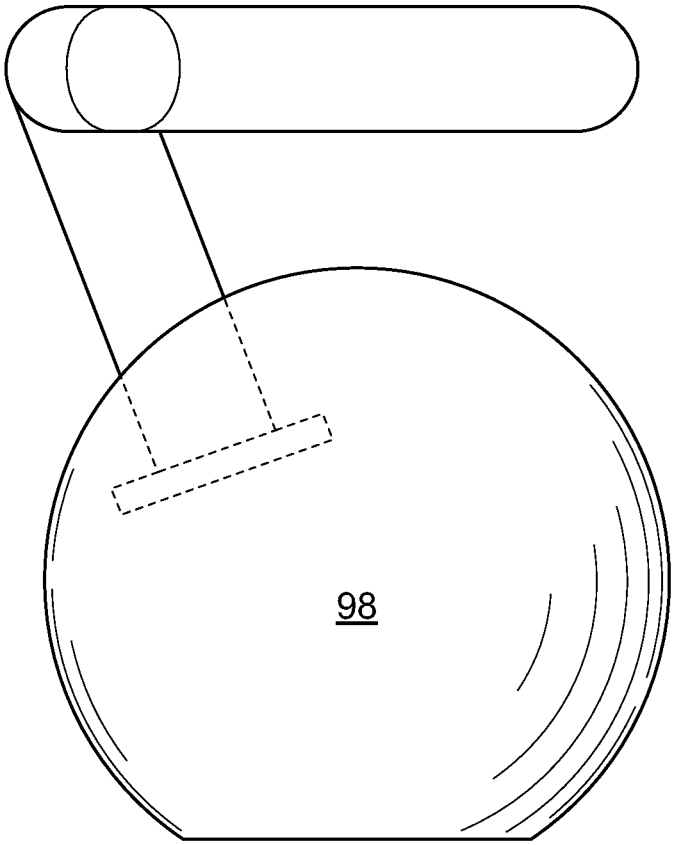
FIG. 19 is a side view of the kettlebell of FIG. 17.
Figure 20:
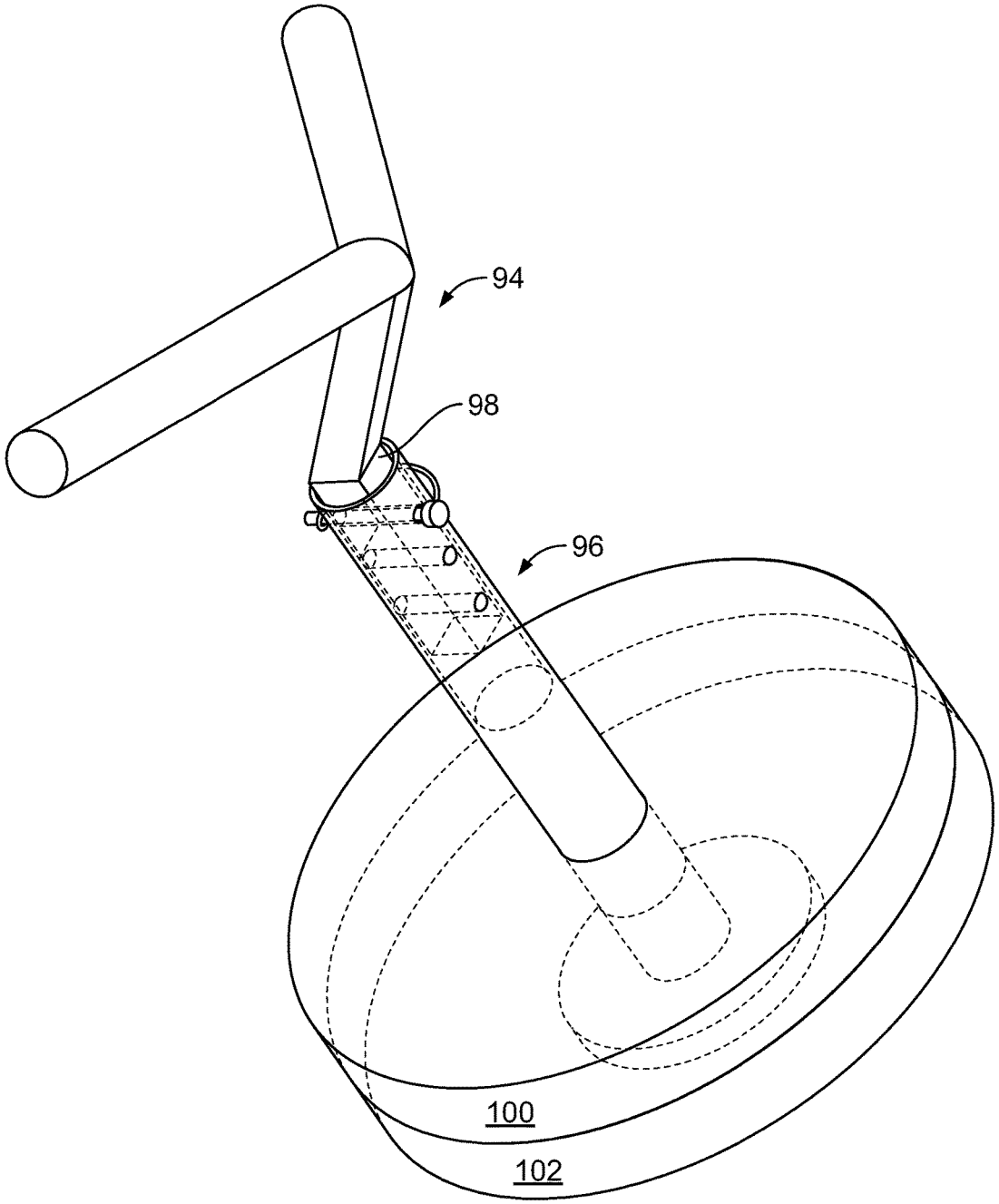
FIG. 20 is an isometric view of an alternative embodiment of the kettlebell of FIG. 1 that includes a handle having a single leg and three arm members.
Figure 21:
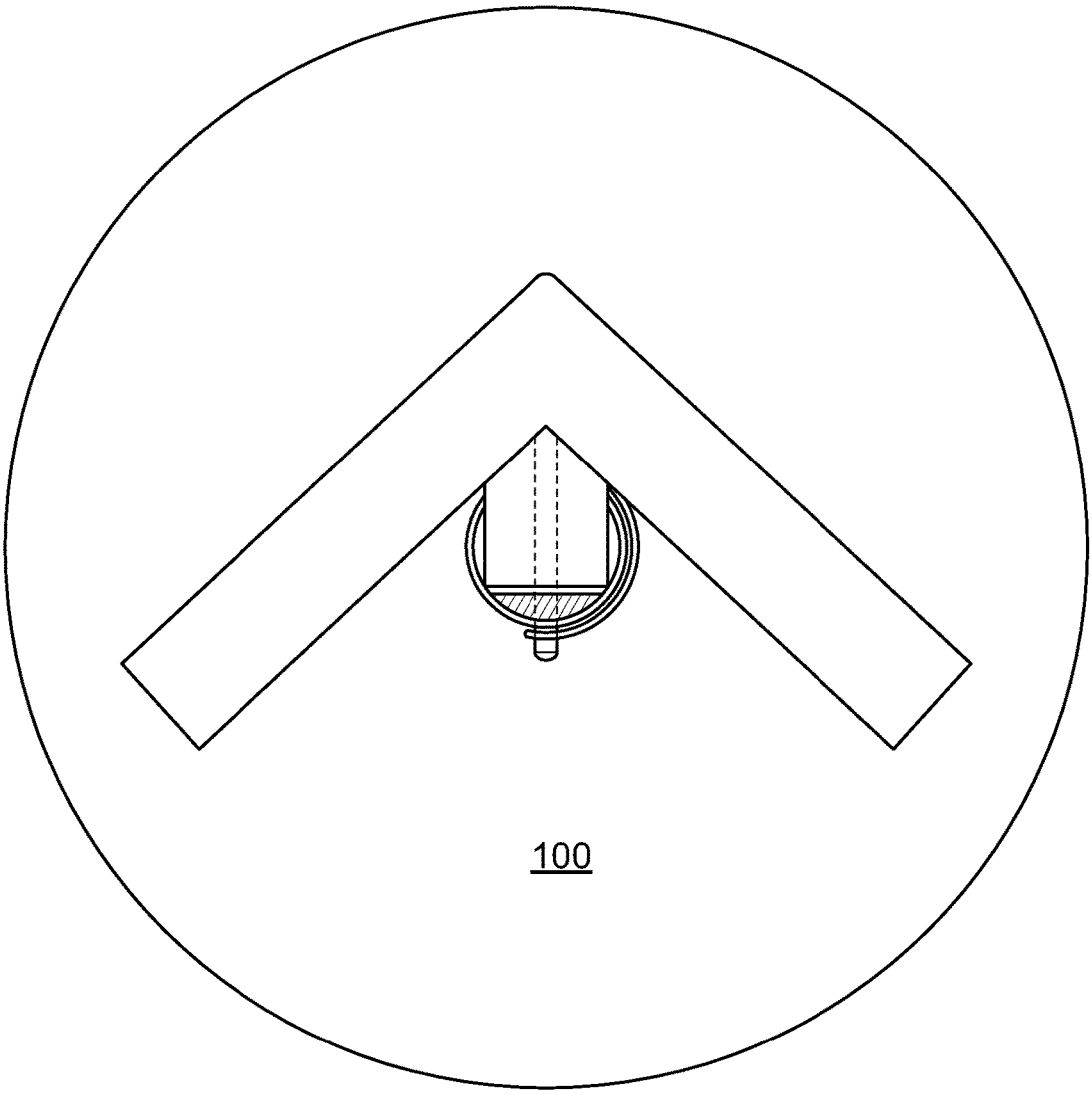
FIG. 21 is a top view of the kettlebell of FIG. 20.
Figure 22:
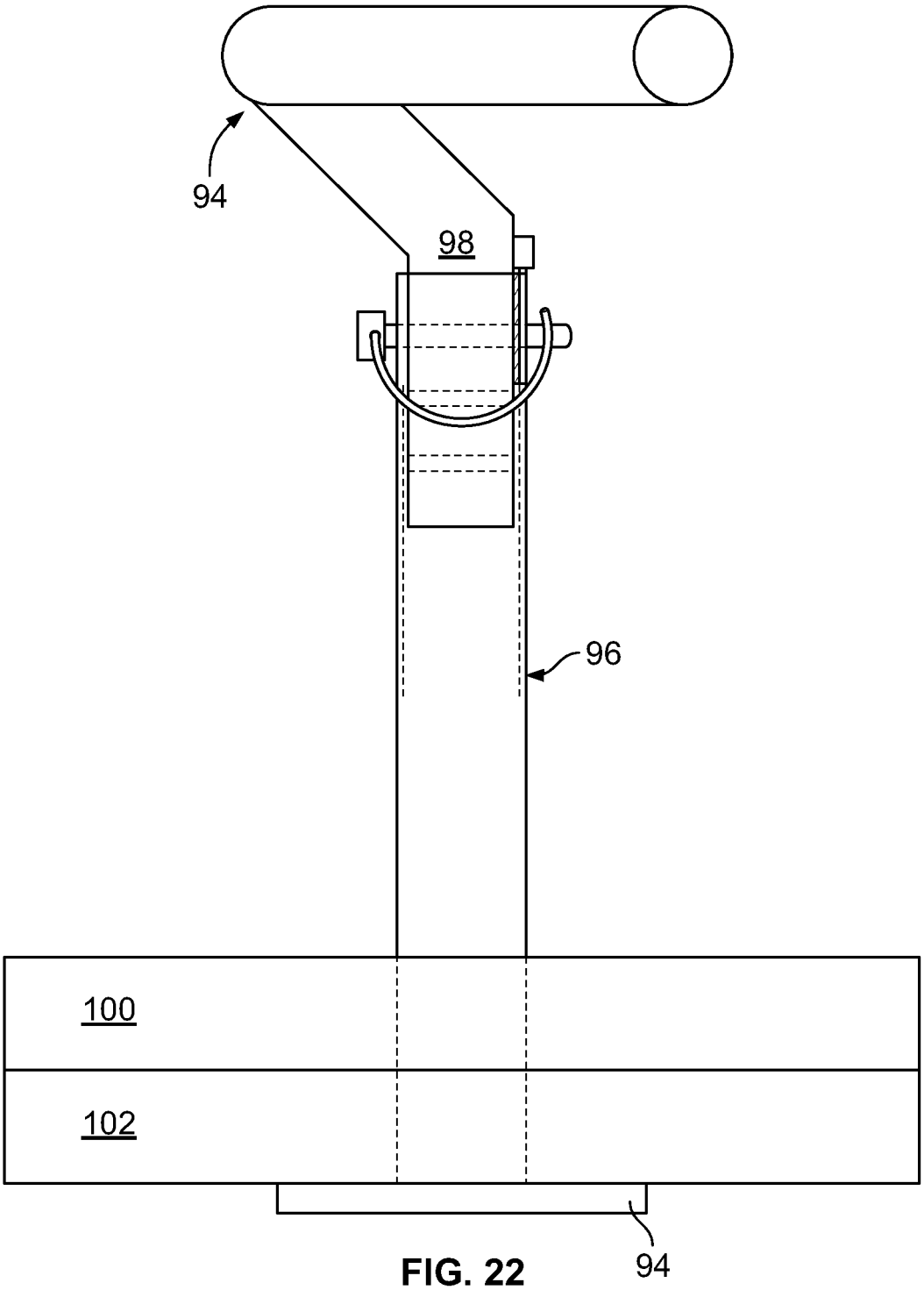
FIG. 22 is a side view of the kettlebell of FIG. 20.

Referring generally to FIGS. 17-19 an alternative embodiment of the weighted exercise device is shown. In the depicted embodiment, the weighted exercise device 86 includes a handle 88, a body 89, and a riser 90. This embodiment is similar to the other previously described embodiments. In this embodiment, the handle include three distinct portions that together generally forms a triangle. In the depicted embodiment, two portions are generally straight and the third portion has a slight curve in the horizontal plane. In the depicted embodiment, the three portions are generally in the same horizontal plane.

Referring generally to FIGS. 20-23, an alternative embodiment of the weighted exercise device is shown. In the depicted embodiment, the weighted exercise device 92 includes a handle 94, a body 96, and a riser 98. This embodiment is similar to the other previously described embodiments. In this embodiment, the riser 98 extends into a body 92 and can be connected and disconnected therefrom. In the depicted embodiment the riser includes a bar shaped portion that fits within a tube shaped portion of the body 92 and a pin and clip configuration secure the riser to the body 92. The body 92 includes a base 94 that provides a horizontal surface for stability when stowed and also serves as a stop for retaining plate weights. In the depicted embodiment, plate weights 100, 102 with center aperture can be fit over the tube shaped body portion and retained on the body portion. Optionally a spring clip or a collar with a set screw can be used to hold the plate weights 100, 102 down on the base 94 of the body 92.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A weighted exercise device comprising:

a handle;

a body below the handle; and a riser that connects the handle to the body, wherein the handle includes a first portion and a second portion that define an angle between 60 and 120 degrees relative to each other, and wherein the first portion and the second portion are in a first plane and the riser extends from the handle towards the body in a second plane, wherein the first plane is generally horizontal and the second plane is generally vertical.

2. The weighted exercise device of claim 1, wherein the riser includes a first leg connected between the first portion of the handle and the body and a second leg connected between the second portion of the handle and the body.

3. The weighted exercise device of claim 1, wherein the riser includes a single leg connected between the first portion of the handle and the body.

4. The weighted exercise device of claim 3, wherein the first and second portions each have a round cross sectional profile having a diameter between 1 and 3 inches.

5. The weighted exercise device of claim 1, wherein the first portion and second portion of the handle are cantilevered off of the riser.

6. The weighted exercise device of claim 1, wherein the body includes a base configured such that when the base is set on a flat horizontal surface, the first plane is spaced above the flat horizontal surface, and wherein a portion of the riser extends at an angle from vertical from the body to the handle.

7. The weighted exercise device of claim 1, wherein the angle is between 60 and 110 degrees.

8. The weighted exercise device of claim 1, wherein the handle is configured such that a vertical line passing through a center of gravity of the body is positioned at an equal distance between the first and second portions of the handle.

9. The weighted exercise device of claim 1, wherein the first and second portions include hand grips.

10. A weighted exercise device comprising:

a handle, the handle including a first portion and a second portion that extend in a first plane and define an angle between 60 and 120 degrees relative to each other;

a top plate, the top plate including an aperture therein;

a riser that connects the handle to the top plate, the riser extending in a second plane different than the first plane; and a base plate including a boss extending upwardly in a vertical plane through the aperture in the top plate, the vertical plane different than both the first and second planes.

11. The weighted exercise device of claim 10, further comprising plate weights stacked between the top plate and the base plate.

12. The weighted exercise device of claim 10, wherein the boss is threaded and is configured to engage a threaded nut that, when engaged with the threads on the boss, secures the base plate towards the top plate.

13. The weighted exercise device of claim 10, wherein the first plane is generally horizontal.

* * * * *